United States Patent [19]

Bitzer

[11] 4,179,658

[45] Dec. 18, 1979

[54] SECRET-SIGNALLING SYSTEM UTILIZING NOISE COMMUNICATION

[75] Inventor: David R. Bitzer, Hyattsville, Md.

[73] Assignee: The United States of America as represented by the Secretary of the Army, Washington, D.C.

[21] Appl. No.: 755,010

[22] Filed: Aug. 23, 1968

[51] Int. Cl.[2] ..... H04K 1/00

[52] U.S. Cl. ..... 325/34; 325/32; 325/49; 325/65; 325/138

[58] Field of Search ..... 325/32, 34, 49, 65, 325/138, 42; 331/78

[56] References Cited

U.S. PATENT DOCUMENTS 3,391,339 7/1968 Lynch ..... 325/49

*Primary Examiner*—Howard A. Birmiel

*Attorney, Agent, or Firm*—John R. Utermohle

[57] ABSTRACT

A secret-signaling, transmitted-reference, spread-spectrum system, utilizing a suppressed-noise carrier for the information signal in combination with a delayed-noise, suppressed carrier of a fixed frequency in order to spectrum-spread the voice signal across the noise signal in the same frequency band. The receiver of the system delays the transmitted signal input which is taken together with the undelayed transmitted signal to determine correlation in order to extract, from the transmitted spread-spectrum signal, solely the information signal generated.

18 Claims, 2 Drawing Figures

SECRET-SIGNALLING SYSTEM UTILIZING NOISE COMMUNICATION

SUMMARY OF THE INVENTION

The present invention is a secret-signaling, transmitted-reference, spread-spectrum system, utilizing a suppressed, noise carrier for the information signal in combination with a delayed-noise, suppressed carrier of a fixed frequency, in order to spectrum-spread the voice signal across the noise signal in the same frequency band, so as to avoid square-law detection, such as by a conventional FM receiver.

PRIOR ART

Prior art secret-signaling systems are much more vulnerable to square-law detection by a conventional FM receiver than is the present invention. The use, in the present secret-signaling system, which is a transmitted-reference, spread-spectrum system, of a suppressed-noise carrier for the information signal in combination with a delayed-noise, suppressed carrier of a fixed frequency, in order to spectrum-spread the voice signal across the noise signal in the same frequency band, gives the present invention a low detectability quality. Prior art devices employ superposition techniques to mask the information signal rather than the spectrum-spreading concepts employed in the present invention. Spectrum-spreading is accomplished in the present invention by employing single-sideband, suppressed-carrier techniques. Utilization of a noise signal for the suppressed carrier decreases the detectability of the information signal beyond that accomplished by the prior art devices.

Prior art devices, such as shown in U.S. Pat. No. 2,401,403, which issued to Bedford on 4 June 1946, utilize the broad concept of a multiple-tap delay line being employed in both the transmitter and receiver of a secret-signaling device so as to produce a code-wave reference signal which is multiplied with the information signal in the transmitter, the reciprocal of the code wave being multiplied with the incoming transmitted signal in the receiver to obtain the information signal of the output separated from the code-wave reference signal. However, devices of this type do not employ spectrum-spreading techniques, utilizing a suppressed-noise carrier for the information signal in combination with a delayed-noise signal to transmit the secret signal, and therefore do not achieve the low detectability of the present invention. U.S. Pat. Nos. 2,129,860 to Mitchell, 2,476,337 to Varian, 2,777,897 to Gretener et al., and 3,231,818 to Court, are exemplary of secret-signaling systems employing prior art techniques having a higher degree of detectability than the present invention. They do not utilize a suppressed-noise carrier, but rather utilize the superposition of noise upon the information signal to mask the information signal, as was previously mentioned. Although U.S. Pat. No. 3,231,818 to Court utilizes a barker audio signal to FM modulate an AM-modulated program audio signal, it does not employ the use of a suppressed-noise carrier of the information signal in combination with a delayed-noise, suppressed carrier of a fixed frequency as the transmitted secret signal, and does not utilize noise-modulation to spectrum-spread the voice signal across the noise signal, as is done in the present invention.

An object of the present invention is to provide a new and improved secret-signaling system which overcomes the disadvantages of the prior art.

Another object of the present invention is to provide a new and improved secret-signaling system employing suppressed-carrier techniques.

A further object of the present invention is to provide a new and improved secret-signaling system utilizing a suppressed-noise carrier for the information signal.

A still further object of the present invention is to provide a new and improved secret-signaling system wherein the information signal is spectrum-spread across the noise signal in the same frequency band.

A still further object of the present invention is to provide a new and improved secret-signaling system having a low detectability.

Other objects and many of the intended advantages of this invention will be readily appreciated as the invention becomes better understood by reference to the following description, when taken in conjunction with the following drawings, wherein.

Figure 1:
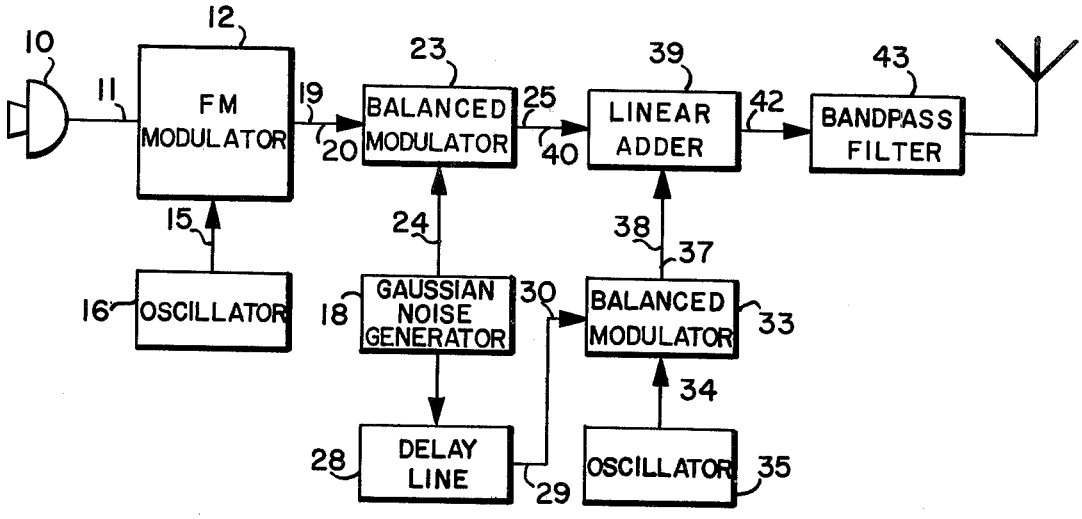
FIG. 1 is a block diagram of the transmitter of the preferred embodiment of the present invention.

Referring now to FIG. 1, which is a block diagram of the transmitter of the preferred embodiment of the present invention, the information signal is introduced into the system by any conventional means, such as a microphone 10, whose output is applied to one input 11 of a narrowband FM modulator 12. Another input 15 to the FM modulator 12 is taken from an oscillator 16, having a fixed frequency which is a designated harmonic of the frequency of a noise generator 18, for example, a value equal to 16 times the frequency of the noise generator 18. The output of the oscillator 16 is modulated by the voice-signal input to the FM modulator 12, yielding a narrowband (6 KC wide) voice-modulated signal at an output 19 of the FM modulator 12, which has a center frequency of 16 times the center frequency of the noise generator 18, which is determined by the frequency of the oscillator 16. For purposes of explanation, the voice-modulated output of the FM modulator 12 will be designated $S_t$, since it is a function of time. This output is applied to one input 20 of a first balanced modulator 23. A second input 24 to the balanced modulator 23 is a 2 MC wide signal, designated $N_t$ for purposes of explanation, which is generated by the band-limited, Gaussian noise generator 18, having a given center frequency.

The configuration of the first balanced modulator 23 and of the Gaussian noise generator 18 is that of a standard, suppressed-carrier modulation system. The Gaussian noise is the suppressed carrier for the voice-modulated information signal. The output 25 of the first balanced modulator 23 is 2 KC wide spectrum centered at a harmonic of the noise generator center frequency, which is 15 times the noise generator center frequency, the other being centered at a harmonic which is 17 times the noise generator center frequency. This double-sideband output of the balanced modulator 23 is two spread-spectrum signals which contain the signal component and the noise component $S_t$, $N_t$. The voice signal $S_t$ is spread across the noise signal $N_t$ and is reduced by a factor of approximately 24 dbs.

The noise signal $N_t$ generated by the Gaussian noise generator 18 is also sent through a delay line 28 where it is delayed by a time designated tau ($\tau$). An output 29 of the delay line 28 is simply the delayed reference noise signal $N_{(t+\tau)}$. This delayed noise signal is applied to one input 30 of a second balanced modulator 33. A second input 34 to the second balanced modulator 33 is a fixed frequency of a harmonic of the noise generator 18 center frequency, for example, 18 times the noise generator center frequency, and which is supplied by means of a second oscillator 35. The configuration of the second balanced modulator 33 and the second oscillator 35 is once again that of a suppressed-carrier modulation system. An output 37 of the second balanced modulator 33, therefore, is two 2 MC-wide sidebands centered at the harmonics of the noise generator center frequency, which are 17 times the noise generator center frequency and 19 times the noise generator center frequency, respectively. The double-sideband output of the second balanced modulator 33 is the delayed noise signal $N_{(t+\tau)}$ modulating the output of the second oscillator 35, which in reality are spread-spectrum signals of the delayed noise signal.

The double-sideband output of the second balanced modulator 33 is applied to one input 38 of a linear adder 39, and the double-sideband output of the first balanced modulator 23 is applied to a second input 40 of the linear adder 39. The linear adder 39 combines both these double sideband outputs. The upper-sideband output of the first balanced modulator 23 is a spread-spectrum signal of the voice signal, spread across the noise signal and having a 2 MC bandwidth centered at the harmonic frequency equal to 17 times the noise generator center frequency; and the lower sideband output of the second balanced modulator 33 is a spread-spectrum signal of the delayed noise signal, having a 2 MC bandwidth also centered at the harmonic frequency equal to 17 times the noise generator center frequency. When added in the linear adder 39, the resultant 2 megacycle-wide spectrum, at the harmonic frequency equal to 17 times the noise generator center frequency, is a spread-spectrum signal containing the information-signal components, noise-signal components, and delay-noise components, and may be represented by the signal $S_t, N_t + N_{(t+\tau)}$. A spread-spectrum output of the linear adder 39, designated by the numeral 42, is passed through a bandpass filter 43 having a 2 MC bandwidth centered at the harmonic frequency equal to 17 times the noise generator center frequency; therefore, the output of the bandpass filter 43 is the linear adder 39 output for the harmonic frequency equal to 17 times the noise generator center frequency, and this is the transmitted secret signal.

Figure 2:
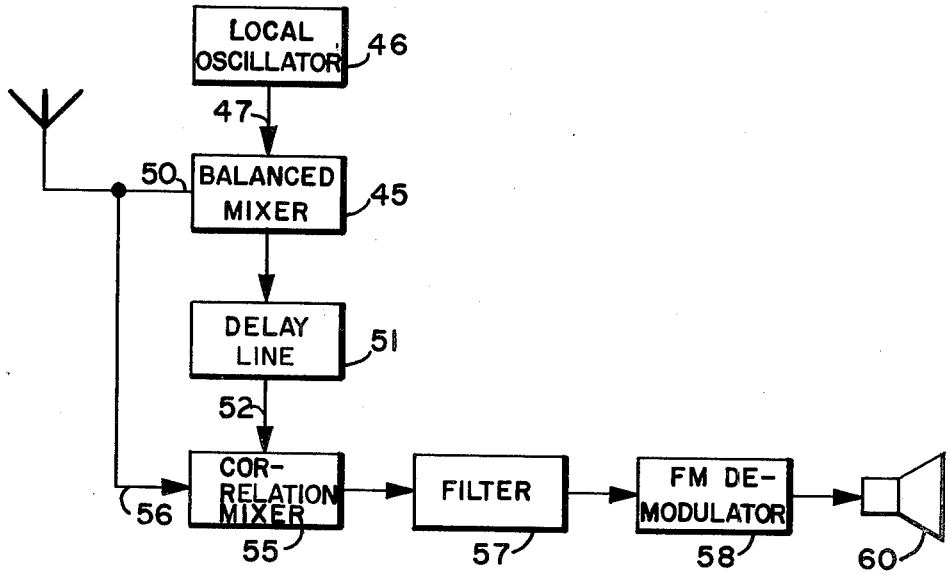
FIG. 2 is a block diagram of the receiver of the preferred embodiment of the present invention.

Referring now to FIG. 2, which is a block diagram of the receiver of the preferred embodiment, the secret signal generated by the transmitter is received and applied to a balanced mixer 45 where it is heterodyned with a local oscillator frequency supplied by a local oscillator 46 which is applied to one input 47 of the balanced mixer 45, the transmitted signal $S_t, N_t + N_{(t+\tau)}$ being applied to a second input 50 to the balanced mixer 45. The balanced mixer 45 output, which is offset in frequency from the input, contains all of the components of the input frequency (information signal components, noise components and the delay noise components). The output of the balanced mixer 45 is applied to a delay line 51 having a delay which is equal to the delay provided by the delay line 28 in the transmitter. The delayed signal, which may be represented by $[S_{(t+\tau)}][N_{(t+\tau)}] + N_{(t+2\tau)}$, is applied to one input 52 of a correlation mixer 55. The input signal $S_t, N_t + N(_{t+\tau})$ is applied to a second input 56 of the correlation mixer 55, where the delayed transmitted secret signal is multiplied by the input transmitted secret signal. (Correlation occurs due to the fact that the delay line 28 of the transmitter and the delay line 51 of the receiver have the same delay.) All the resultant cross products of this multiplicative output of the correlation mixer 55, except one, appear as broadband noise spectra centered at the IF frequency of the balanced mixer 45, or between 0 and 2 MC.

The cross product of primary concern is the delayed voice-modulated signal multiplied by the square of the delayed noise signal $[S_{(t+\tau)}][N^2_{(t+\tau)}]$. Since the square of the delayed noise signal has only positive values, a signal produced by this cross product has a frequency equal to the IF of the balanced mixer 45 plus or minus some change in frequency determined by the instantaneous amplitude of the delayed voice-modulated-signal term, and whose envelope amplitude is determined by the instantaneous value of the square of the delayed noise. The output of the correlation mixer 55 is then passed through a narrowband IF filter 57, which allows the signal components, which are the delayed voice-modulated signal $S_{(t+\tau)}$, to pass through while rejecting the undesired noise products. The narrowband filter 57 output is applied to a standard FM demodulator 58 where symmetrical limiting removes the amplitude variations caused by the noise component. The resultant signal, which contains only the signal, or voice, components as modulation is then demodulated in a conventional manner, which then may be fed to conventional output means, such as a speaker 60.

The actual values of the delay time and noise generator frequency have not been specified, other than in generally applicable terms, since they may be any numerical value which is necessary to meet a specific communication problem.

It is to be understood that the above-described embodiment of the invention is merely illustrative of the principles thereof, and that numerous modifications and embodiments of the invention may be derived within the spirit and scope of the invention. For example, multiplexing techniques may be used in the transmitter to provide the secret signal instead of a linear adder and second suppressed carrier.

What is claimed is:

1. In a secret-signalling system, the combination comprising:

an information signal source;

a reference signal source, the reference signal being a noise signal;

means for providing a first suppressed-carrier signal from the information signal, the first suppressed carrier providing means being connected to the information signal source and the reference signal source, the reference signal being the carrier signal;

means for providing a delayed reference signal from the reference signal;

means for combining the delayed reference signal with the first suppressed carrier information signal to yield at least one first spread spectrum signal of the information signal in combination with the reference signal;

means for selecting the desired first spread spectrum signal to be transmitted to yield a desired secret signal which is to be transmitted; and means for receiving the transmitted first spread spectrum signal and extracting from the first spread spectrum signal received, solely the information signal generated.

2. A secret-signaling system in accordance with claim 1, wherein:

the information signal is a voice signal.

3. A secret-signaling system in accordance with claim 2, wherein:

the reference signal source is a band-limited Gaussian noise generator for generating the noise signal at a first desired bandwidth and center frequency.

4. A secret-signaling system in accordance with claim 3, wherein:

the information-signal source comprises a narrow band FM modulator.

5. A secret-signaling system in accordance with claim 4, wherein:

the narrow band FM modulator has a first input, a second input, and an output.

6. A secret-signaling system in accordance with claim 5, wherein:

the information signal source further comprises a first oscillator means for generating a frequency which is a first desired harmonic of the desired noise center frequency connected to the first FM-modulator input, the voice signal being connected to the second FM-modulator input so as to produce a narrow-band voice-modulated signal having a second desired center frequency which is the first desired harmonic generated by the first oscillator means at the output of the FM modulator.

7. A secret-signaling system in accordance with claim 6, wherein:

the Gaussian noise generator has a first and a second output.

8. A secret-signaling system in accordance with claim 7, wherein:

the suppressed-carrier-providing means comprises a first balanced modulator having a first input connected to the FM-modulator output and a second input connected to first output of the Gaussian noise generator, and an output which is a second and third spread-spectrum signal which has first and second sidebands of the voice-modulated signal, the second and third spread-spectrums containing the voice signal component and the noise component, and the first and second sidebands having second and third bandwidths, respectively, equal to the noise generator first desired bandwidth, the first sideband being an upper sideband of the voice-modulated signal having a second desired center frequency which is a second desired harmonic of the desired noise center frequency, the second desired center frequency being above the first desired harmonic of the desired noise center frequency, and the second sideband being a lower sideband of the voice-modulated signal and having a third desired center frequency which is a third desired harmonic of the desired noise center frequency, the third desired center frequency being below the first desired harmonic of the desired noise center frequency.

9. A secret-signaling system in accordance with claim 8, wherein:

the voice-modulated signal is spread across the noise signal in both spectrums.

10. A secret-signaling system in accordance with claim 9, wherein:

the delayed-reference-signal-providing means comprises a first delay line having an input and an output, the noise generator being connected to the input of the first delay line and the output being the reference signal delayed by the selected delay time of the first delay line.

11. A secret-signal system in accordance with claim 10, wherein:

the combining means comprises a means for providing a second suppressed carrier signal from the reference signal, the second-suppressed-carrier-providing means being connected to the output of the first delay line.

12. A secret-signaling system in accordance with claim 11, wherein:

the combining means further comprises a second oscillator means for generating a frequency which is a fourth desired harmonic of the desired noise center frequency.

13. A secret-signaling system in accordance with claim 12, wherein:

the second suppressed-carrier-providing means comprises a second balanced modulator having a first input connected to the delay line output, a second input connected to the second oscillator means, and an output which is a third and fourth sideband signal containing the delayed noise components, the third and fourth sideband signals having fourth and fifth bandwidths, respectively, equal to the noise generator first desired bandwidth, the third sideband being an upper sideband of the delayed noise signal, the third sideband having a fourth desired center frequency which is a fourth desired harmonic of the desired noise center frequency, the fourth desired center frequency being above the second desired center frequency; the fourth sideband being a lower sideband of the delayed noise signal, the fourth sideband having a fifth desired center frequency which is a fifth desired harmonic of the desired noise center frequency, the fifth desired harmonic of the desired noise center frequency being equal to the second desired harmonic, the fifth desired center frequency being equal to the second desired center frequency.

14. A secret-signaling system in accordance with claim 13, wherein:

the combining means further comprises a linear adder having a first input which is connected to the output of the second balanced modulator, a second input which is connected to the output of the first balanced modulator and an output which is the sum of the first suppressed carrier-informational signal and the second suppressed carrier delayed noise signal, the upper-sideband output of the first balanced modulator and the lower-sideband output of the second balanced modulator being summed in the linear adder to yield the desired secret signal to be transmitted whose components are the first spread-spectrum signal of the information signal in combination with the noise signal combined with the delayed-noise signal, the resultant linear adder output having a bandwidth equal to the noise generator first desired bandwidth and a center frequency equal to the second desired harmonic of the desired noise center frequency.

15. A secret-signaling system in accordance with claim 14, wherein:

the transmitted secret-signal-selecting means is a bandpass filter connected to the output of the linear adder, and having an output which is the desired transmitted secret signal, the bandpass filter having a bandwidth equal to the noise generator first desired bandwidth and a center frequency equal to the second desired harmonic of the desired noise center frequency so as to only pass the desired transmitted secret signal.

16. A secret-signaling system in accordance with claim 15, wherein the receiving and extracting means comprises:

a third local oscillator means;

a balanced-mixer means having a first input which is the desired transmitted secret signal and a second input which is the output of the third local oscillator, the output of the third local oscillator being heterodyned with the desired transmitted secret signal to yield a balanced-mixer output which contains all the components of the desired transmitted secret signal, offset in frequency; and a second delay means, having a delay time equal to the delay time of the first delay means, connected to the output of the balanced mixer, and having an output which is the balanced-mixer output delayed by the selected delay time of the second delay means.

17. A secret-signaling system in accordance with claim 16, wherein the receiving and extracting means further comprises:

a correlation-mixer means connected to the second delay means and to the first input to the balanced mixer, having a first input which is the delayed desired transmitted secret signal, a second input which is the desired transmitted secret signal, and a correlated output which is the multiplicative outputs of the desired transmitted secret signal and the delayed desired transmitted secret signal, each of the multiplicative outputs, except one, being broadband noise spectra centered within a bandwidth equal to the noise generator first desired bandwidth, at the heterodyne frequency, the one output being a desired correlated multiplicative output whose components are the delayed information signal components multiplied by the square of the delayed noise components, the desired correlated multiplicative output having a center frequency equal to the heterodyne frequency varied by a change in frequency determined by the instantaneous amplitude of the delayed information signal and an envelope amplitude determined by the instantaneous value of the square of the delayed noise signal; and a narrow-band filter connected to the output of the correlation mixer, the narrow-band filter passing solely the components of the delayed-information signal, and rejecting the noise products which are undesired, so as to have an output which is composed of solely the components of the delayed-information signal.

18. A secret-signaling system in accordance with claim 17, wherein the receiving and extracting means further comprises:

an FM demodulator connected to the output of the narrow band filter, for removing the amplitude variations caused by the noise components to yield a signal which contains only the voice components as modulation, having a demodulated output which is the desired information signal.

* * * * *